United States Patent [19]

Powell

[11] Patent Number: 4,678,200

[45] Date of Patent: Jul. 7, 1987

[54] PLATFORM FOR ATTACHING TO A SKI TO PROVIDE A MONOSKI

[76] Inventor: William Powell, R.D. 3, Box 95, Andover, N.J. 07821

[21] Appl. No.: 811,290

[22] Filed: Dec. 20, 1985

[51] Int. Cl.[4] ..... A63C 5/00

[52] U.S. Cl. ..... 280/607; 280/618

[58] Field of Search ..... 280/607, 601, 618, 633, 280/809, 12 K

[56] References Cited

U.S. PATENT DOCUMENTS

| | | | |
|---|---|---|---|
| 2,007,366 | 9/1970 | Schnid | 280/607 |
| 3,802,714 | 4/1974 | Freegard | 280/607 |
| 3,854,738 | 12/1974 | Fish | 280/607 |
| 3,942,810 | 3/1976 | Salomon | 280/618 |
| 4,022,491 | 5/1977 | Powell | 280/607 |

FOREIGN PATENT DOCUMENTS

| | | | |
|---|---|---|---|
| 2446654 | 8/1980 | France | 280/601 |
| 0604766 | 9/1978 | Switzerland | 280/607 |
| 0621483 | 2/1981 | Switzerland | 280/607 |

*Primary Examiner*—John J. Love
*Assistant Examiner*—Richard Camby
*Attorney, Agent, or Firm*—Alfred C. Hill

[57] ABSTRACT

The platform comprises a single base member secured to the upper surface of a ski at a predetermined location along the length thereof; a first plate disposed substantially parallel to and spaced a first predetermined distance above the base member to support the toe portion of both feet of a skier; a second plate disposed substantially parallel to and spaced a second predetermined distance above the base member in a predetermined longitudinal spaced relationship with the first plate to support the heel portion of both feet of the skier; a first column extending at a first predetermined angle from the base member to the first plate to support the first plate above the base member; a second column extending at a second predetermined angle from the base member to the second plate to support the second plate above the base member; and a rigid bar-like member secured to and extending between the first and second plates. A releasable retaining means for one foot of the skier is provided having a toe portion secured to the first plate and a heel portion secured to the second plate. A slide plate is releasably fastened to the other foot of the skier with the slide plate having a forward portion thereof releasably secured to the first plate and a rearward portion thereof secured to the second plate. The slide plate could be replaced by conventional retaining means.

20 Claims, 4 Drawing Figures

PLATFORM FOR ATTACHING TO A SKI TO PROVIDE A MONOSKI

BACKGROUND OF THE INVENTION

The present invention relates to a ski for either snow or water skiing and more particularly to a platform for attaching to a ski to provide a monoski for snow or water skiing.

The term "monoski" refers to that type of ski in which the skier stands on a single ski, skid or runner member.

The usual difficulties which are to be dealt with using conventional skis comprise the maintenance of an ideal boy position which will vary according to speed and running situation, the displacement of body weight from one ski to the other and the command of the ski edges connected with such body displacement, the guidance of the skis, particularly their maintenance in parallel position, and finally the adoption of the position of the skis and of the position of the body to the ground and the track to be followed.

These difficulties usually are gradually overcome by the skier with increasing ability, but a greater amount of strength and concentration is needed which diminishes the pleasure of skiing and results in a retardation of the excursion on the skis. When the skis are not maintained in an exact parallelism, one of the other ski not only moves in a longitudinal direction but will also skid laterally which will slow down the running speed.

When skiing over undulated ground, particularly when crossing the undulations at an angle other than right angles, a considerable expenditure of force is required to keep the skis parallel to each other.

A monoski overcomes these disadvantages and will enable a novice to obtain greater pleasure from skiing.

Known monoskis have either a single platform or two spaced platforms supported in an elevated position above the ski by two columns. When using a single platform both feet of the skier are retained in identical feet retaining mean. When using two platforms the toes of both feet are retained on one platform and the heels of both feet are retained on the second platform. In each of the single platform or dual platform arrangement the width of the platforms are wider than the width of the ski.

In another prior art monoski arrangement the ski itself is made wide enough to have retained on the upper surface thereof two identical feet retainer mean to hold the feet of the skier in a side-by-side relationship on the ski without any overhang of the feet retaining means.

SUMMARY OF THE INVENTION

It should be noted that the monoski of the present invention can be used as a snow ski or a water ski with the feet retaining means of the water ski actually making contact with the feet of the skier while in a snow ski the feet retaining means would include ski boots worn by the skier on his or her feet with the ski boots then being retained in boot retainer means.

An object of the present invention is to provide an improved platform for attaching to a ski to provide a monoski.

Another object of the present invention is to provide a platform for a monoski having reduced weight when compared to the known platforms for monoskis.

Still another object of the present invention is to provide a platform for a monoski presenting reduced resistance or drag in the skiing medium (snow or water) then the known monoski platforms.

A feature of the present invention is the provision of an improved platform for attaching to a ski to provide a monoski comprising a single base member; means to secure the base member at a predetermined location on an upper surface of the ski; a first plate disposed substantially parallel to and spaced a first predetermined distance above the base member, the first plate being capable of supporting the toe portion of both feet of a skier; a second plate disposed substantially parallel to and spaced a second predetermined distance above the base member in a predetermined longitudinal spaced relationship with the first plate, the second plate being capable of supporting the heel portion of both feet of the skier; a first column extending at a first predetermined angle from the base member to the first plate to support the first plate above the base member; a second column extending at a second predetermined angle from the base member to the second plate to support the second plate above the base member; and a rigid bar-like member secured to and extending between the first and second plates.

Another feature of the present invention is the provision of a releasable retaining means for one foot of the skier, the retaining means having a toe portion secure to the first plate and a heel portion secured to the second plate; and a slide plate releasably fastened to the other foot of the skier, the slide plate having a forward portion thereof releasably secured to the first plate and a rearward portion thereof releasably secured to the second plate.

A further feature of the present invention is the provision of the base member, the first and second plates, the first and second columns and the bar-like member being formed as an integral unit.

Still another feature of the present invention is the provision of the first and second columns having a streamlined outer surface to reduce resistance thereof in the skiing medium (snow or water); and the first and second columns, the first and second plates, the bar-like member and the base member being interconnected to provide an opening therebetween to further reduce resistance in the skiing medium particularly during a turning or similar maneuver.

Still a further feature of the present invention is to provide a non-stick finish on at least the first and second plates and the slide plate.

Still another feature of the present invention is the provision of enabling the base member to be secured to the upper surface of the ski by permanent fastening means or to provide an arrangement secured to the upper surface of the ski at the predetermined location to releasably secure the base member therein.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figures 1, 2, 3, 4:
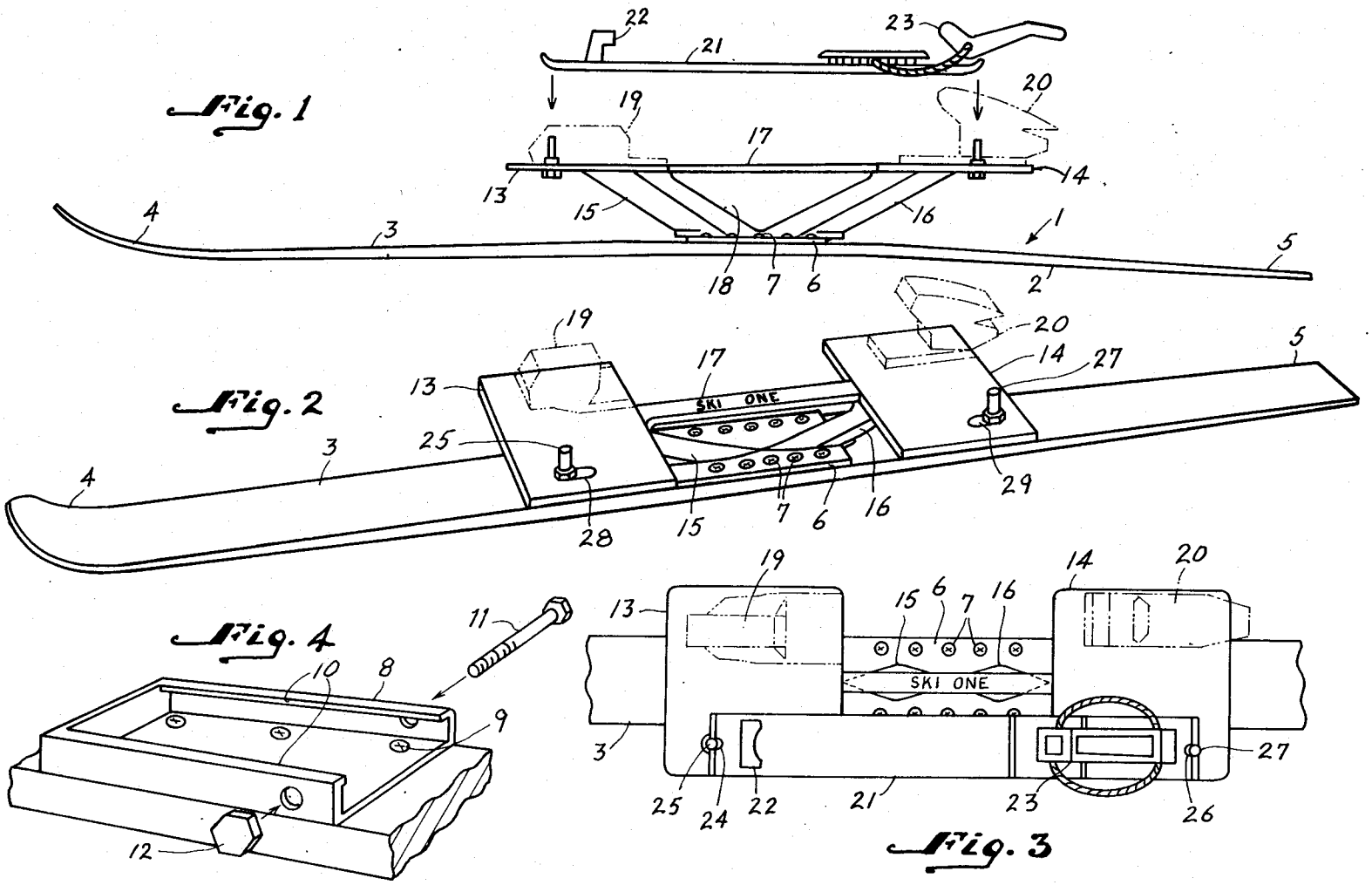
FIG. 1 is a side, partially exploded, view of one embodiment of the monoski platform in accordance with the principles of the present invention.
FIG. 2 is a perspective view of the monoski platform of FIG. 1.
FIG. 3 is a top view of the monoski platform of FIG. 1.
FIG. 4 is a perspective view of an alternative embodiment for securing the base member of the monoski platform of FIG. 1 to the upper surface of the ski of FIG. 1.

Referring to FIGS. 1, 2 and 3, the ski to which the platform in accordance with the principles of the present invention is attached includes a body member 1 having an elongated lower gliding surface 2, an elongated upper surface 3 coextensive with lower surface 2, an upturned tip portion 4 at one end of the upper and lower surfaces 2 and 3 and a tail portion 5 at the other end of the upper and lower surfaces 2 and 3.

The platform of the present invention includes a single base member 6 to be secured to the upper surface 3 by fastening means, such as bolts 7 passing through base member 6 and threaded into threaded holes provided in body member 1. Base member 6 is secured at a predetermined location on the upper surface 3 between the tip portion 4 and the tail portion 5 depending upon the skiers particular requirements.

Alternatively, the base member 6 can be releasably secured to the upper surface 3 of body member 1 by many different arrangements one of which is shown in FIG. 4. The releasably securing means shown in FIG. 4 includes an arrangement 8 secured to the top surface 3 of body member 1 by means of fastening means 9, such as bolts threaded into threaded holes in body member 1. Arrangement 8 includes lips 10 to releasably engage the top surface of base member 6 with base member 6 being modified to receive therethrough the bolt 11. In this embodiment the base member 6 will be inserted into arrangement 8 and held in position therein by bolt 11 and nut 12. With this structure, it would be possible for a skier to have one platform to elevate the skier above surface 3 of body member 1 with arrangement 8 being provided on different skis for different snow or water conditions thereby enabling a rapid attachment of the platform to the selected one of the different skis. If the arrangement 8 provided a strong enough engagement with base member 6 it would be possible to do away with the bolt 11 and nut 12.

Returning now to FIGS. 1, 2 and 3, the remainder of the improved platform will now be described. A first plate 13 is disposed substantially parallel to and spaced a first predetermined distance above base member 6 closer to tip portion 4 than the tail portion 5. The first plate 13 is capable of supporting the toe portion of both feet of the skier. A second plate 14 is disposed substantially parallel to and spaced a second predetermined distance above base member 6 closer to the tail portion 5 than the tip portion 4 in a predetermined longitudinal space relationship with the first plate 13. The second plate 14 is capable of supporting the heel portion of both feet of the skier. A first column 15 extending toward tip portion 4 at a first predetermined angle from base member 6 to first plate 13 supports the first plate 13 above base member 6. A second column 16 extends toward tail portion 5 at a second predetermined angle from base member 6 to support second plate 15 above base member 6. A rigid bar-like member 17 is secured to and extends between first and second plates 13 and 14.

As is obvious from FIGS. 1–3, and in particular FIG. 3, the outer surface of the first and second columns 15 and 16 are streamlined to reduce resistance (drag) of these columns in the skiing medium particularly when skiing in the forward direction. Additionally, columns 15 and 16, plates 13 and 14, bar-like member 17 and base member 6 are interconnected in such a manner so as to provide an opening 18 therebetween to further reduce resistance in the skiing medium particularly during a turning or similar maneuver where the monoski of the present invention moves laterally with respect to the forward direction.

The base member 6, columns 15 and 16, plates 13 and 14 and member 17 can be molded as an integral unit or otherwise can be interconnected by a welding process or the like to provide an integral unit.

The provision of bar-like member 17 provides a convenient handle to carry the platform of the present invention and, hence, the monoski when the platform is attached to a ski to provide a monoski.

At least the top surface of plates 13 and 14 can be provided with a non-stick finish such as would be provided by a plastic material, such as Teflon, or by providing the plates 13 and 14 out of aluminum stock and anodizing this aluminum stock to provide an aluminum oxide on the surface of plates 13 and 14. Of course the other members of the platform of the present invention could also be made to have a non-stick surface to prevent the accumulation of the skiing medium, and in particular snow, on the surface thereof. As shown in FIG. 1 the upper surface 3 may have a predetermined curvature in the area of base member 6. In this instance the bottom surface of base member 6 would be correspondingly curved so as to match the shape of the curvature of surface 3 so that there is a no-gap contact between the bottom of base member 6 and upper surface 3.

The height of plates 13 and 14 above base member 6 would be determined by the width of the ski it is used with. In addition, if upper surface 3 has a curvature, the first and second predetermined distances of plates 13 and 14 above base member 6 are different to place plates 13 and 14 an equal distance from upper surface 3. If no such curvature is present the first and second predetermined distances of plates 13 and 14 above base member 6 would be equal. As illustrated in FIG. 1 upper surface 3 has a curvature such that the forward portion of body member 1 is thinner than the rearward portion thereof. Thus, the second predetermined distance is greater than the first predetermined distance so that plates 13 and 14 are equidistance from upper surface 3. The difference is only a small fraction of an inch.

While it is shown in the Figures that base member 6 has a narrower width than the body member 1, it would of course be possible to provide base member 6 with a width either equal to or wider than body member 1.

According to another aspect of the present invention a releasable retaining means for one foot of the skier has a toe portion 19 secured to plate 13 and a heel portion 20 secured to plate 14. A slide plate 21 is provided to retain the other foot of the skier in a releasable relationship. This is shown in FIGS. 1 and 3 as including a toe retaining device 22 and a heel retaining device 23. The slide plate 21 has a notch 24 in the forward portion thereof to engage a post 25 in a releasable manner, post 25 being secured to plate 13, and a notch 26 in a rearward portion thereof to engage a post 27 in a releasable manner, post 27 being secured to plate 14. Note in particular FIG. 3. The posts 25 and 26 are longitudinally adjustable by means of slots 28 and 29 formed, respectively, in plates 13 and 14. This longitidinal adjustment enables the accommodation of different length slide plates 21.

While it is shown in FIGS. 1–3 that a conventional retaining means is provided for the right foot and the slide plate arrangement is provided for the left foot of the skier, it should be obvious that the conventional retaining means could be provided for the left foot and the slide plate arrangement could be provided for the right foot depending upon the skiers preference. Additionally, it would be possible to substitute a conventional retaining means for the slide plate 21.

Preferably, the slide plate 21, which can also be called a small ski, should have a non-stick finish, such as mentioned herein above with respect to plates 13 and 14, so as to prevent the accumulation of the skiing medium thereon, particularly when skiing in snow.

In the arrangement illustrated in the Figures of the drawing the slide plate 21 can be instantaneously removed from plates 13 and 14. This will enable the skier to use slide plate 21 to aid in overcoming the loss of balance, getting on and off chair lifts, riding T-bars and poma lifts and should a skier find him or herself on a slope they cannot handle, they can use the slide plate 21 and the body member 1 (the larger ski) to make it down the slope with confidence.

The retaining means including toe portion 19 and heel portion 20 can be any conventional retaining means normally found on water skis, or for retaining ski boots when the skiing medium is snow.

While I have described the principles of my invention in connection with specific apparatus, it is to be clearly understood that this description is made only by way of example and not as a limitation of the scope of my invention as set forth in the objects thereof and in the accompanying claims.

I claim:

1. An improved platform for attaching to a ski having an upturned tip portion on one end thereof and a tail portion on the other end thereof to provide a monoski comprising:

a single base member;

means to secure said base member at a predetermined location on an upper surface of said ski between said tip portion and said tail portion;

a first plate disposed substantially parallel to and spaced a first predetermined distance above said base member, said first plate being capable of supporting the toe portion of both feet of the skier;

a second plate disposed substantially parallel to and spaced a second predetermined distance above said base member in a predetermined longitudnal spaced relationship with said first plate, said second plate being capable of supporting the heel portion of both feet of said skier;

a first bar-like column extending toward said tip portion at a first predetermined acute angle from said base member to said first plate to support said first plate above said base member;

a second bar-like column extending toward said tail portion at a second predetermined acute angle from said base member to said second plate to support said second plate above said base member; and a rigid bar-like member secured to and extending between said first and second plates.

2. A platform according to claim 1, wherein said means to secure includes fastening means to secure said base member to said upper surface at said predetermined location.

3. A platform according to claim 2, further including a releasable retaining means for one foot of said skier, said retaining means having a toe portion secured to said first plate and a heel portion secured to said second plate; and a slide plate releasably fastened to the other foot of said skier, said slide plate having a forward portion thereof releasably secured to said first plate and a rearward portion thereof releasably secured to said second plate.

4. A platform according to claim 2, further including a releasable retaining means for each foot of said skier, said retaining means each having a forward portion secured to said first plate and a rearward portion secured to said second plate.

5. A platform according to claim 2, wherein said base member, said first and second plate, said first and second columns and said bar-like member are an integral unit.

6. A platform according to claim 2, wherein said first and second columns have a streamlined outer surface to reduce resistance thereof in a skiing medium, and said first and second columns, said first and second plates, said bar-like member and said base member are interconnected to provide an opening therebetween to further reduce resistance in said skiing medium particularly during a turning or similar maneuver.

7. A platform according to claim 1, wherein said means to secure includes an arrangement secured to said upper surface at said predetermined location to releasable secure said base member therein.

8. A platform according to claim 7, further including a releasable retaining means for one foot of said skier, said retaining means having a toe portion secured to said first plate and a heel portion secured to said second plate; and a slide plate releasably fastened to the other foot of said skier, said slide plate having a forward portion thereof releasably secured to said first plate and a rearward portion thereof releasably secured to said second plate.

9. A platform according to claim 7, further including a releasably retaining means for each foot of said skier, said retaining means each having a forward portion secured to said first plate and a rearward portion secured to said second plate.

10. A platform according to claim 7, wherein said base member, said first and second plates, said first and second columns and said bar-like member are an integral unit.

11. A platform according to claim 7, wherein said first and second columns have a streamlined outer surface to reduce resistance thereof in a skiing medium, and said first and second columns, said first and second plates, said bar-like member and said base member are interconnected to provide an opening therebetween to further reduce resistance in said skiing medium particularly during a turning or similar maneuver.

12. A platform according to claim 1, further including a releasable retaining means for one foot of said skier, said retaining means having a toe portion secured to said first plate and a heel portion secured to said second plate; and a slide plate releasably fastened to the other foot of said skier, said slide plate having a forward portion thereof releasably secured to said first plate and a rearward portion thereof releasably secured to said second plate.

13. A platform according to claim 1, further including a releasable retaining means for each foot of said skier, said retaining means each having a forward portion secured to said first plate and a rearward portion secured to said second plate.

14. A platform according to claim 1, wherein said base member, said first and second plates, said first and second columns and said bar-like member are an integral unit.

15. A platform according to claim 1, wherein said first and second columns have a streamlined outer surface to reduce resistance thereof in a skiing medium, and said first and second columns, said first and second plates, said bar-like member and said base member are interconnected to provide an opening therebetween to further reduce resistance in said skiing medium particularly during a turning or similar maneuver.

16. A platform according to claim 1, wherein at least said first and second plates have a non-stick finish.

17. A platform according to claim 1, wherein said upper surface has a predetermined curvature in at least said predetermined location and said base member is shaped to match said predetermined curvature.

18. A platform according to claim 1, wherein said upper surface has a predetermined width, and said base member has a width less than said predetermined width.

19. A platform according to claim 1, wherein said first and second predetermined distances are equal.

20. A platform according to claim 1, wherein said upper surface has a predetermined curvature adjacent said predetermined location, said base member is shaped to match said predetermined curvature and said first and second columns at said base member are unequally space from a high point of said predetermined curvature, and said second predetermined distance is slightly different than said first predetermined distance to place said first and second plates an equal distance above said upper surface.

* * * * *